US006412321B1

(12) United States Patent
Aramburu et al.

(10) Patent No.: US 6,412,321 B1
(45) Date of Patent: Jul. 2, 2002

(54) LOCKING CYLINDER

(75) Inventors: Luis Angel Ruano Aramburu; Jose Alcelay Bea, both of San Sebastian (ES)

(73) Assignee: Talleres de Escoriaza, S.A. (TESA), Irun (Guipuzcoa) (ES)

( * ) Notice: Subject to any disclaimer, the term of this patent is extended or adjusted under 35 U.S.C. 154(b) by 0 days.

(21) Appl. No.: 09/574,629

(22) Filed: May 19, 2000

(30) Foreign Application Priority Data

Jul. 27, 1999 (ES) ..... 9901691

(51) Int. Cl.[7] ..... E05B 49/00
(52) U.S. Cl. ..... 70/278.3; 70/278.7; 70/283.1
(58) Field of Search ..... 70/386, 278.2, 70/278.3, 408, 283, 283.1, 278.7

(56) References Cited

U.S. PATENT DOCUMENTS 4,458,512 A * 7/1984 Gelhard ..... 70/277
5,337,588 A * 8/1994 Chhatwal ..... 70/278
5,351,042 A * 9/1994 Aston ..... 340/825.31
5,373,718 A * 12/1994 Schwerdt et al. ..... 70/278
5,628,217 A * 5/1997 Herrera ..... 70/279
5,791,176 A * 8/1998 Montesinos Alonso ..... 70/277
5,826,450 A * 10/1998 Lerchner et al. ..... 70/278
5,839,305 A * 11/1998 Aston ..... 70/278
6,227,020 B1 * 5/2001 Lerchner ..... 70/278.3

* cited by examiner

*Primary Examiner*—Lynne H. Browne
*Assistant Examiner*—John B. Walsh
(74) *Attorney, Agent, or Firm*—Neilds & Lemack

(57) ABSTRACT

Locking cylinder, particularly an electronic locking cylinder and with electromechanical rotational blocking in which the electronic key (64) has facing electrical terminals (66) on blade (65), and the rotating core (2 or 3) of the cylinder has an external annular track (6) that is electrically conducting and with its internal face communicates with an electrical contact (5) supported on terminal (66); whereas the external annular track (6) is supported in the electrical brushes (7) of external (2) and internal (3) rotors; there is a first modular box (8) on the inside of a cast hollow part (1*a*) of external rotor (2) which box contains electrical brush (7), processing unit (31) and an electromechanical locking device, which incorporates a ball (19) and a vertical tumbler (16); as well as a second modular box (9) containing electrical brush (7) and the autonomous electrical source; the two modules are connected by the electrical conductor (10).

18 Claims, 8 Drawing Sheets

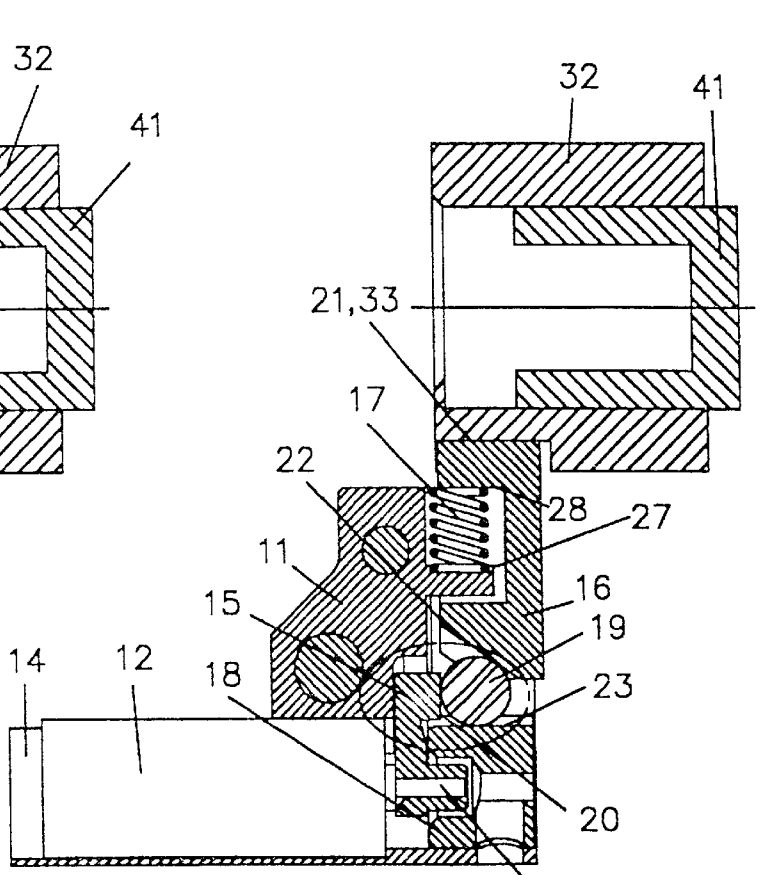
Fig.3
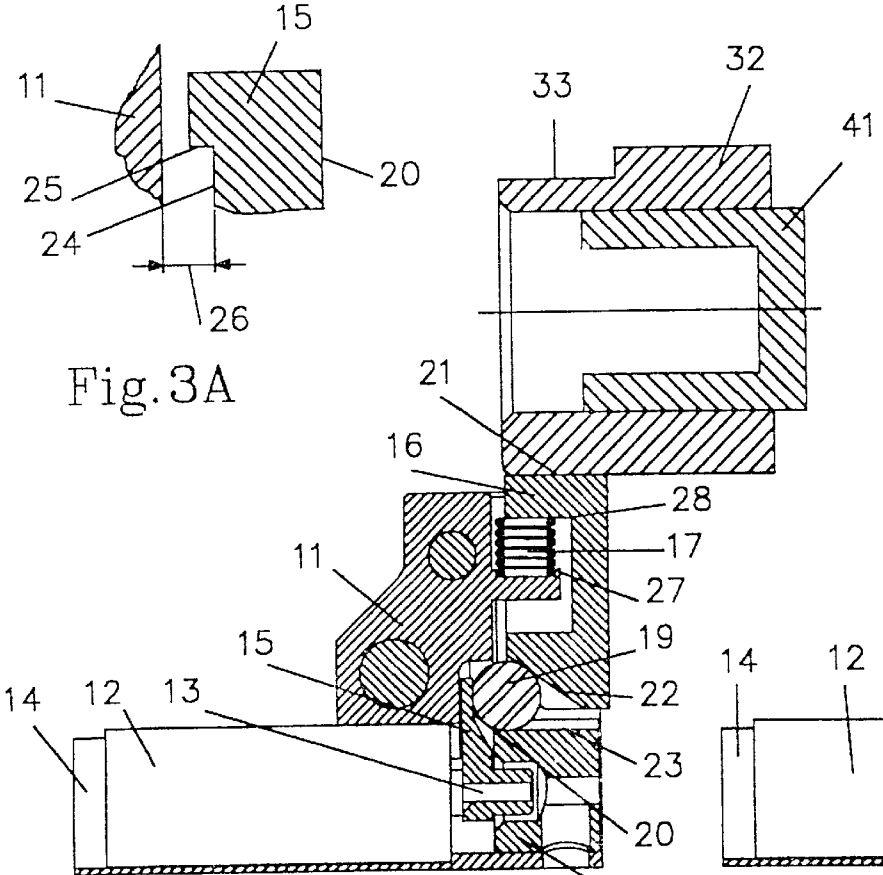
Fig.4
Fig.3A 4
39
38
40
38
40
44
35
45
42
32
41
47
43
33
34
33
3
3'
2
2a
49
49a
43
1
57
60
59
16
50
63
62
6
2
2a
5
5a
7
7a
31
8
56
10
9

49a
57
54
52
51
58
55
59
56
58
50a
50a
33
50
61
47
2

57
60
56
58
57
58
55
59
61

49
49a
43
57
55,56,58
51
X
50
65
16
61
47,69
2
1
31
8
9
10

49a
59
57
54
51
58
1
63
62
65
50a

64

64
66
XX
65

64
66
XXI
65

64
66
XXII
65

65

65

72
65

72

64
66
XXIII
XXIII
65

64
66
XXIV
XXIV
65

64
66
XXV
XXV
65

65

65

65
72

LOCKING CYLINDER

FIELD OF THE INVENTION

The invention refers to an electronic locking cylinder provided with electromechanical rotational blocking.

PRIOR ART

The application of electronics for operating locking cylinders presents specific problems relating to the autonomy of functioning by means of incorporation of its own electrical supply source, and attaining a reduced size that can be extreme, in order to be able to place everything in the small space where it can reside in the planar vertical extension of a locking cylinder of European profile (in a shape reminiscent of a pear), since this European profile is used most often and in order to conceive the most unfavorable case of the cylinder types most often employed.

Most of the energy consumption is used for activating the rotational-blocking electromechanical device. The smaller the abrasion in this blocking device, the smaller will be the electrical consumption, and its autonomy of functioning will therefore be greater.

Many rotational-locking electromechanical devices are known in this regard, in which the locking is established by means of a piece that can be displaced vertically in the radial direction at the cylindrical rotational element for which one desires to block the rotational movement.

Among these devices, it is known that the positions of said vertically displaceable piece for rotational locking and release are directly determined by a rectangular cam disk, with rounded ends that is mounted diametrically in the rotational axis of output of an electrical micromotor. The locking position is established when the cam disk is vertical (its larger sides are in vertical position) and vice versa.

The autonomy of the device will be greater, the smaller the abrasion opposing the micromotor drive. For this, in this type of device, clearances are available above and below the ends of the cam disk situated in vertical position or locking position, which clearances are relatively large in size, in order to guarantee that the cam disk will not abrade when being rotated by the micromotor.

Consequently, the rectangular cam disk remains mounted like a brace. Considerable forces that are produced in order to entrain the rotating operation when the device is in the locked position are applied to said brace. These forces are integrally supported by the brace and are transmitted to the micromotor axis in the form of bending moments that produce deformations and permanent clearances, which exercise negative effects on the process, making it worse each time.

Another disadvantage of this type of known device is that it requires a great precision in order to place the cam disk in the vertical locking position; said micromotors lack means to guarantee said precision and require some other complementary means that detects and assures the vertical locking position, which implies expense as well as the necessary space for it that is of critical availability.

If said vertical locking position of the rectangular cam disk is not exact, said clearances at the ends of this cam disk will be greater and will have very negative effects: first, the bending torque on the micromotor axis will be increased, so as to force rotation; secondly a rotational moment will also appear on said micromotor axis; thirdly, the locking position will lose firmness and the device is less reliable.

DESCRIPTION OF THE INVENTION AND ADVANTAGES

The new electronic cylinder comprises: a double-body static frame, of European profile in the form of a pear, for activating the cylinder from the external and internal sides of the lock, each having external and internal rotational cores or rotors which rotate in the recess of said two casings of the static frame and each of which possesses a channel for introduction of the blade of a corresponding electronic key provided with an interactive electronic circuit that can be coded electronically; an electrical contact located in a radial housing of each of said external and internal rotors that communicates with its said key channel coinciding with the place where either one of the two opposing electrical terminals on the blade of said electronic key ends up, when it is inserted operatively in said key channel; an electrically conducting annular track that encircles each one of said external and internal rotors and has its internal face communicating electrically with each said electrical contact of these rotors; an electrical brush, which, in each one of these rotors, communicates electrically with the external face of said annular track and is elastically loaded against a second compression spring; an electronic processing unit that electrically communicates with said electrical brushes of the external and internal rotors; a vertical retractile tumbler that is mounted against a helical compression spring radially at said external rotor and that belongs to a rotational blocking electromechanical device of said external rotor that is electrically connected to said electronic processing unit; a first eccentric cam installed between said external and internal rotors; an external socket enclosed axially between said first eccentric cam and the external rotor; an internal socket enclosed axially between said first eccentric cam and the internal rotor; an external shoe that is installed with axial play between said first eccentric cam and the external rotor, which external shoe has a sliding fit with respect to the inside of said external socket and with respect to a first diametric planar lug of the external rotor, which is located in the recess of this external shoe; an internal shoe which is installed with axial play between said first eccentric cam and the internal rotor, which internal shoe has a sliding fit with respect to the inside of said internal socket and with respect to a second diametric planar lug which is located in the recess of this internal shoe; a first modular box that has dimensions adapted to the inside of a first cast hollow part attached to the external rotor that is made in said static double-body frame, and which first modular box contains said electrical brush of the external rotor, said electronic processing unit and said rotational-locking electromechanical device of the external rotor; a second modular box that has dimensions adapted to the inside of a second cast hollow part attached to the internal rotor that is made in said double-body static frame, and whose second modular box contains an autonomous electrical supply source and the said electrical brush corresponding to the internal rotor; an electrical conductor is connected between said first and second modular boxes.

Overall, said electromechanical device of rotational locking of said external rotor comprises an armature, an autonomous electrical micromotor that has a horizontal output axis of rotation and is located in a housing of said armature, a vertical plate cam disk, a retractile vertical tumbler located in said housing of the armature and sticking out through the upper plane of this armature, a helical compression spring mounted vertically between horizontal first and second walls of said armature and retractile tumbler, respectively, a base anchored at the bottom to said armature in vertical alignment with said retractile tumbler, and a ball disposed freely in a variable space bounded between said plate cam disk, retractile tumbler and base; said plate cam disk has a vertical cam disk front horizontally opposing said ball and projecting in continuous form; said retractile tumbler has an upper planar face in permanent contact with the periphery of said external socket with peripheral chamfer, and opposite to said upper planar face, said retractile tumbler has on the bottom an inclined plane of concave transverse profile circumscribed by an arc of greater radius than said ball and opposing this ball; said base has on the top a horizontal plane with concave transverse profile circumscribed by an arc of greater radius than said ball and which is in permanent contact with this ball and vertically opposing said inclined plane of the retractile tumbler; said ball has a diameter sufficient for simultaneous contact with said cam disk front, concave inclined plane of the retractile tumbler and concave horizontal plane of the base, and longitudinally to said concave horizontal plane, between said ball and its point of contact with said concave inclined plane, there is a maximum distance that is equal to the horizontal variation of projection between the sections that project to a variable extent from said front of the cam disk.

In this new device, the vertically displaceable piece that establishes the locking (in this case, the retractile tumbler) does not enter into direct contact with the cam disk (in this case, a plate cam disk), which will perform the original adjustment of the states of locking or release of the device. The relation between the retractile tumbler and the plate cam disk is established through said ball that can be freely displaced, supported along said concave plane of said base anchored to said armature, and by means of said concave inclined plane that belongs to the retractile tumbler itself.

The plate cam disk requires clearance only in its back, because the ball is free and its contact with the rotating plate cam disk does not produce appreciable friction, so that the micromotor does not produce a large amount of work and does not penalize the autonomy of the available electrical supply.

The locked position is and remains established when the plate cam disk presents the most projecting part of its cam disk front to the ball; then, this ball contacts the concave inclined plane of the retractile tumbler without losing simultaneous contact with the horizontal concave plane of said base and with said cam disk front.

In this locked position, when rotation is forced, the force produced on the retractile tumbler is in great part transmitted to the armature by means of said base. Only the remainder of the force is transmitted to the cam disk and in a manner that is hardly unfavorable for the output axis of the micromotor, since it is transmitted in a direction parallel to this micromotor axis and at a scant radial distance from the latter; moreover, this force only can be displaced along the most reduced clearance that in this case only exists at the back of the cam disk. This solution provides a great robustness to the device as well as reliable functioning.

Another characteristic of the invention is that there is a projection in the back face of the plate cam disk, which is located in the zone in which the front of the cam disk is most projecting toward the ball, said projection projects to an extent less than said clearance existing in the remainder of the back face of the plate cam disk that is not occupied by this projection.

Said projection makes possible a decrease of said dorsal clearance of the planar cam disk, precisely in the zone of this disk, in which will be produced the locked state; therefore, this projection does not change the no-abrasion conditions in the remainder of the rotational movement of the plate cam disk.

The great capacity for adaptation derived from the modular design for the first and second boxes that are interconnected by an electrical conductor must be emphasized. This concept can be applied to an extra-long static casing (for doors of special width, greater than normal); this can be done simply by making the interconnecting electrical conductor longer. Also, the concept can be applied to static casings of other profiles, which will always be wider than the European profile. Its application is also possible for remote electrical supply; for this purpose, an external electrical conductor is present that is connected to said first modular box and to a supply source that is external to this locking cylinder.

With respect to the electrical communication between the electronic processing unit and the electronic key, it is emphasized that this electrical communication is maintained during the entire rotational operation, due to the disposition of the annular track with respect to the electrical contact and the electrical brush. This makes it possible to establish an interaction between transmission of data and commands during the rotational operation, starting from the initial concrete moment in which the electronic key code has been validated with its simple introduction into the rotor channel.

The fact should also be emphasized that the annular track, the electrical contact of the rotor and the electrical brush are protected inside the cylinder.

The mounting and functions of the first eccentric cam with respect to the external and internal sockets, the external and internal shoes and the external and internal rotors will be explained in the more detailed description that is made below in relation to the attached drawings.

The preceding description refers to a cylinder that can be actuated by means of a key from both the external side of the lock as well as from its internal side.

When the internal activation is by means of a rotational button (substituting for the key rotor), the new cylinder of the invention comprises: a double-body static frame, of European profile in the form of a pear, for activation of the cylinder from the external and internal sides of the lock; an external rotational core or rotor, which possesses a channel for the introduction of the blade of a corresponding electronic key provided with an interactive electronic circuit that can be coded electronically, which external rotor rotates in the recess of the external body of said static double-body frame double-body; an internal rotational button provided with an axis that rotates in the recess of the internal body of said static double-body frame; an electrical contact located in a radial housing of said external rotor that communicates with its said key channel coinciding with the place where either one of the electrical terminals opposed to one another on the blade of said electronic key end up, when the key is operatively inserted in said key channel; an electrically conducting annular track that encircles said external rotor and has its internal face that electrically communicates with said electrical contact of this external rotor; an electrical brush that communicates electrically with the external face of said annular track and is loaded elastically against a spring; an electronic processing unit that communicates electrically with said electrical brush of the external rotor; a retractile vertical tumbler that is mounted against a helical compression spring radially to said external rotor and that belongs to an electromechanical device for rotational blocking of said external rotor that is connected electrically to said electronic processing unit; a second eccentric cam installed between said external rotor and the axis of said rotational button; a radial vessel axially enclosed between said second eccentric cam and the external rotor; a coupling device or coupling located in the recess of said external socket and between said external rotor and said second eccentric cam; a first modular box that has dimensions adapted to the inside of a first cast hollow part attached to the external rotor and that is made in said static double-body frame, and which first modular box contains said electrical brush of the external rotor, said electronic processing unit and said rotational-locking electromechanical device of the external rotor; a second modular box that has dimensions adapted to the inside of a second cast hollow part attached to the axis of the rotational button and that is made in said static double-body frame, and which second modular box contains an autonomous electrical supply source; an electrical conductor connected between said first and second modular boxes.

In this version of the cylinder of the invention, the electromechanical device for rotational locking of said external rotor is exactly equal to that of the previous version (external key, internal key), and there also exists an external electrical conductor for a supply source different than the one provided in the second modular box.

The assembling and functions of the second eccentric cam with respect to the external socket, the coupling, the external rotor and the internal rotational button will be explained in the detailed description that is given below with respect to the attached drawings.

DRAWING AND REFERENCES

In order to better understand the nature of the present invention, we show in the attached drawings a preferred form of industrial embodiment, which has the nature of merely an illustrative and non-limiting example.

FIG. 1 shows in longitudinal section a cylinder according to the invention, provided with external rotor (2) and internal rotor (3), with an electronic key (64) introduced in external rotor (2); this figure is completed by a diagram of the static double-body frame (1) provided with first (8) and second (9) modular boxes interconnected by means of electrical conductor (10) and showing an external electrical conductor **(10*a*)**.

FIGS. 2 and 2A each show enlargements of detail II circled in FIG. 1, which show two different solutions between the electrical contact (5) and the electrical terminals (66) of electronic key (64).

FIG. 3 shows an enlargement of detail II that is circled in FIG. 1, omitting static frame (1), external rotor (2) and electronic key (64). In this FIG. 3 is shown the state of rotational blocking of external socket (32).

FIG. 3A is an enlargement of the detail circled in FIG. 3, but referring exclusively to the dorsal face (24) of the plate cam disk (15) with respect to armature (11).

FIG. 4 is like FIG. 3, but showing the rotational non-blocking state of external socket (32).

Figure 1:
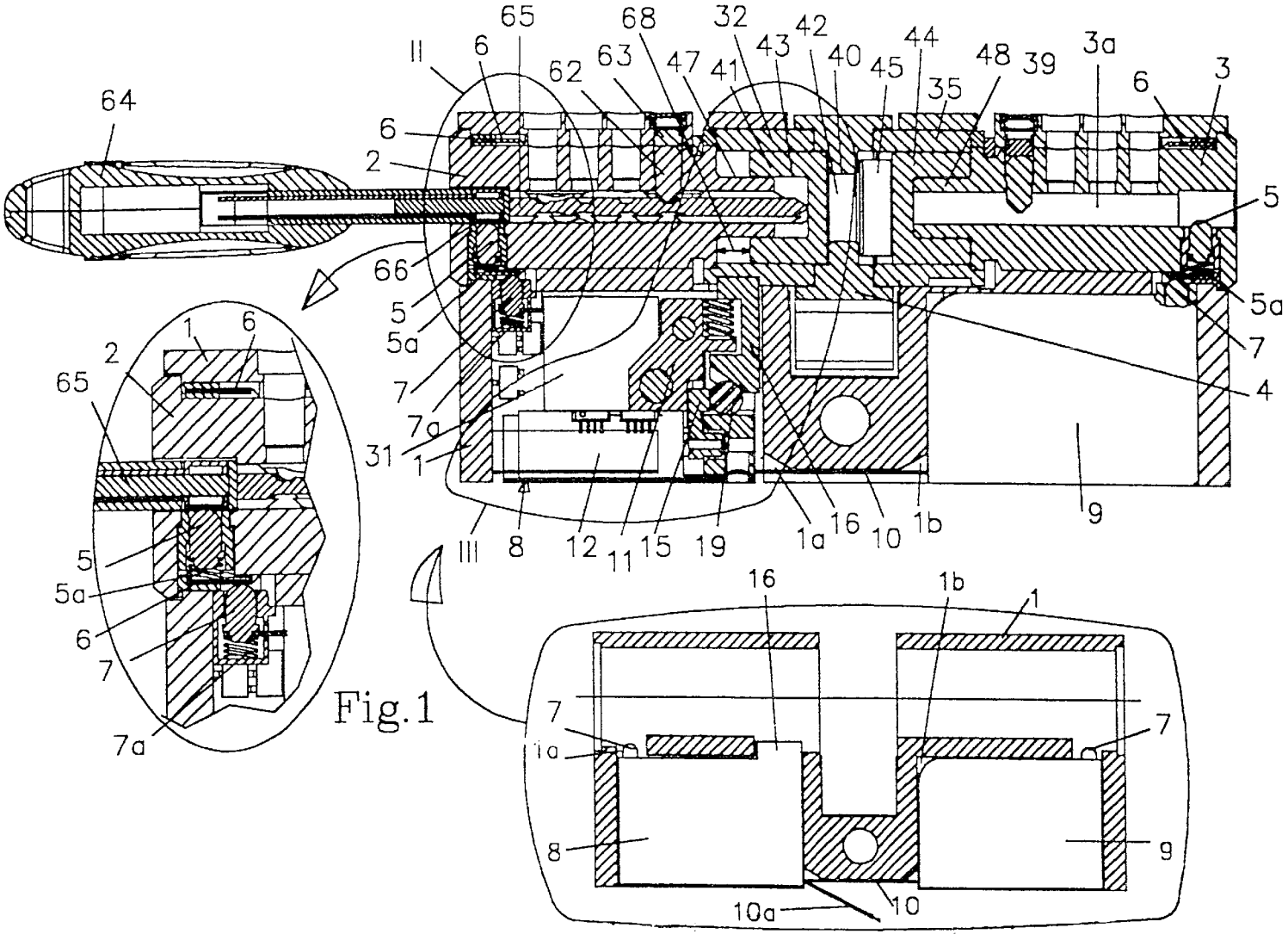

The following references are indicated in these figures:

1.—static double-body frame

1*a*.—first cast hollow part of static frame (1)

1*b*.—second cast hollow part of static frame (1)

2.—external rotor

2*a*.—key channel in external rotor (2)

3.—internal rotor

3*a*.—key channel in internal rotor (3)

4.—first eccentric cam, for external rotor (2)—internal rotor (3)

5.—electrical contact in rotors (2) and (3)

5*a*.—first compression spring

6.—annular track of electrical contact in rotors (2) and (3)

7.—electrical brush in static frame (1)

7*a*.—second compression spring of electrical brush (7)

8.—first modular box

9.—second modular box

10.—electrical conductor between modular boxes (8) and (9)

10*a*.—external electrical conductor of first modular box (8)

11.—armature

12.—autonomous micromotor

13.—output axis of micromotor (12)

14.—housing of the armature (11)

15.—vertical plate cam disk

16.—retractile vertical tumbler

17.—helical compression spring

18.—base

19.—ball

20.—cam-disk front of plate cam disk (15)

21.—upper planar face of tumbler (16)

22.—lower concave inclined plane of tumbler (16)

23.—concave horizontal plane of base (18)

24.—dorsal face of plate cam disk (15)

25.—projection of dorsal face (24)

26.—nominal clearance between dorsal face (24) and armature (11)

27.—first horizontal wall in armature (11)

28.—second horizontal wall in tumbler (16)

31.—electronic processing unit

32.—external socket

33.—peripheral chamfer of external socket (32), internal socket (35) and axial vessel (50)

34.—first front recesses of external socket (32)

35.—internal socket

37.—second front recesses of internal socket (35)

38.—first front teeth of first eccentric cam (4)

39.—second front teeth of first eccentric cam (4)

40.—radial teeth of first eccentric cam (4)

41.—external shoe

42.—first front groove in external shoe (41)
43.—first diametric recess in external shoe (41)
44.—internal shoe
45.—second front groove in internal shoe (44)
46.—second diametric recess in internal shoe (44)
47.—first diametric planar lug of external rotor (2)
48.—second diametric planar lug of internal rotor (3)
49.—rotational button
49*a*.—axis of rotational button (49)
50.—axial vessel
50*a*.—front gaps of axial vessel (50)
51.—second eccentric cam, for rotational button (49)
52.—front pieces in axis (49*a*)
53.—blind axial borehole in axis (49*a*)
54.—axial slots of eccentric cam (51)
55.—coupling device or coupling
56.—body of coupling (55)
57.—axial rod of coupling (55)
58.—paraxial teeth of body (56)
59.—relatively strong helical spring
60.—relatively weak helical spring
61.—enlarged front part of rod (57)
62.—cogs in external (2) and internal (3) rotors
63.—counter-cogs in static frame (1)
64.—electronic key
65.—blade of electronic key (64)
66.—electrical terminals in key (64)
67.—concavities of blade (65)
68.—axial play
69.—polygonal axial opening of axial vessel (50)
70.—electronic integrated circuit
71.—electrical conductor loop
72.—spring

DESCRIPTION OF A PREFERRED EMBODIMENT

FIG. 1 shows a preferred form of embodiment of the new cylinder to be actuated by means of an electronic key (64) both externally as well as internally of the lock; this electronic cylinder comprises: a static double-body frame (1), of European profile in the form of a pear, for activation of the cylinder from the external and internal sides of the lock; each having external (2) and internal (3) rotational cores or rotors, which rotate in the recess of said two bodies of the static frame (1) and each of which possess a channel (2*a*, 3*a*) for introduction of blade (65) of a corresponding electronic key (64) provided with an interactive electronic circuit that can be coded electronically; an electrical contact (5) located in a radial housing in each of said external (2) and internal (3) rotors that communicates with its said key channel (2*a*, 3*a*) coinciding with the place where either one of the two electrical terminals (66) arranged opposite one another on blade (65) of said electronic key (64) will end up, when the key is inserted operatively in said key channel (2*a*, 3*a*); an electrically conducting annular track (6) which encircles each one of said external (2) and internal (3) rotors and has its internal face in electrical communication with each said electrical contact (5) of these rotors (2, 3); an electrical brush (7) which, in each one of said rotors (2, 3), is in electrical communication with the external face of said annular track (6) and loaded elastically against a second compression spring (7*a*); an electronic processing unit (31), which is in electrical communication with said electrical brushes (7) of external (2) and internal (3) rotors; a retractile vertical tumbler (16) which is mounted against a helical compression spring (17) radially to said external rotor (2) and which belongs to an electromechanical device for rotational blocking of said external rotor (7) which is electrically connected to said electronic processing unit (31); a first eccentric cam (4) installed between said external (2) and internal (3) rotors; an external socket (32) enclosed axially between said first eccentric cam (4) and the external rotor (2); an internal socket (35) enclosed axially between said first eccentric cam (4) and internal rotor (3); an external shoe (41) that is installed with axial play between said first eccentric cam (4) and external rotor (2), which external shoe (41) has a sliding fit with respect to the interior of said external socket (32) and with respect to a first diametric planar lug (47) of external rotor (2), which is located in the recess of this external shoe (41); an internal shoe (44) which is installed with axial clearance between said first eccentric cam (4) and the internal rotor (3), which internal shoe (44) has a sliding fit with respect to the inside of said internal socket (35) and with respect to a second diametric planar lug (48), which is located in the recess of this internal shoe (44); a first modular box (8) which has dimensions adapted to the interior of a first cast hollow part (1*a*) attached to external rotor (2) that is made in said static double-body frame (1), and which first modular box contains said electrical brush (7) of external rotor (2), said electronic processing unit (31) and said electromechanical device for rotational locking of external rotor (2); a second modular box (9) which has dimensions adapted to the inside of a second cast hollow part (1*b*) attached to internal rotor (3), which is made in said static double-body frame (1), and which second modular box (9) contains an autonomous electrical supply source and said electrical brush (7) corresponding to internal rotor (3); an electrical conductor (10) is connected between said first (8) and second (9) modular boxes.

The assembly of electrical contact (5), annular track (6) an electrical brush (7) provides for the fact that in the case of any rotational operation made with electronic key (64) there is a permanent communication between this electronic key (64) and processing unit (31), which makes possible an interaction of reading, transmitting and modifying data relating numerous possibilities of application. This assembly is duplicated by internal rotor (3).

When it is required that the first modular box (8) is connected to an external supply source, there is an external electrical conductor (10*a*) which is connected to said first modular box (8) and to a supply source external to this locking cylinder.

The modularity provided by the first (8) and second (9) modular boxes can also be applied when the cylinder is comprised of a single body and is of European profile. In this case, an auxiliary cast hollow part will be made in the door for the second modular box (9), which is very simple.

Electrically conducting annular track (6) is a ring opened by one of its generatrices. This execution can facilitate the mounting of the same; but it is obvious that this annular track (6) can be of closed ring form.

Figure 2:
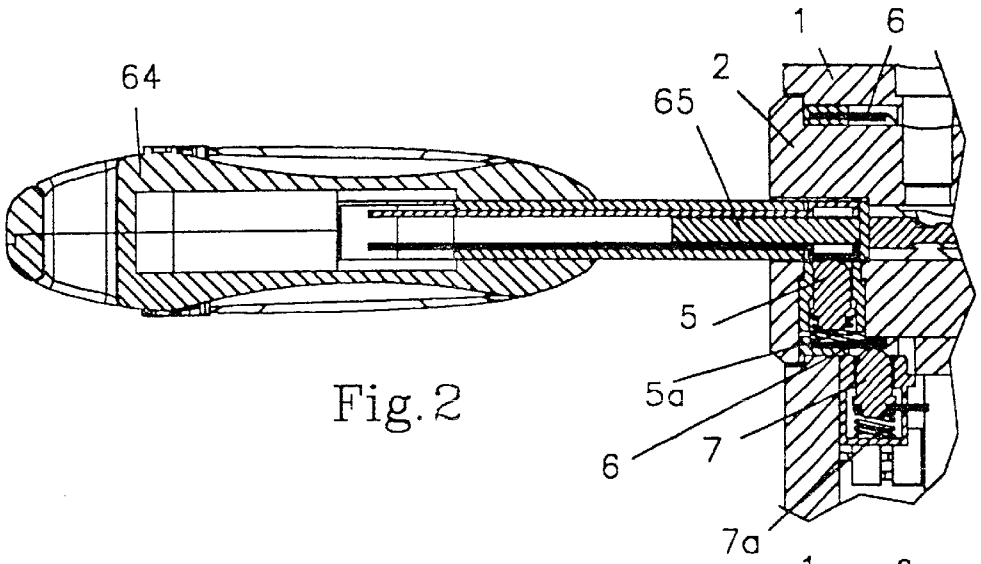
Figure 2A:
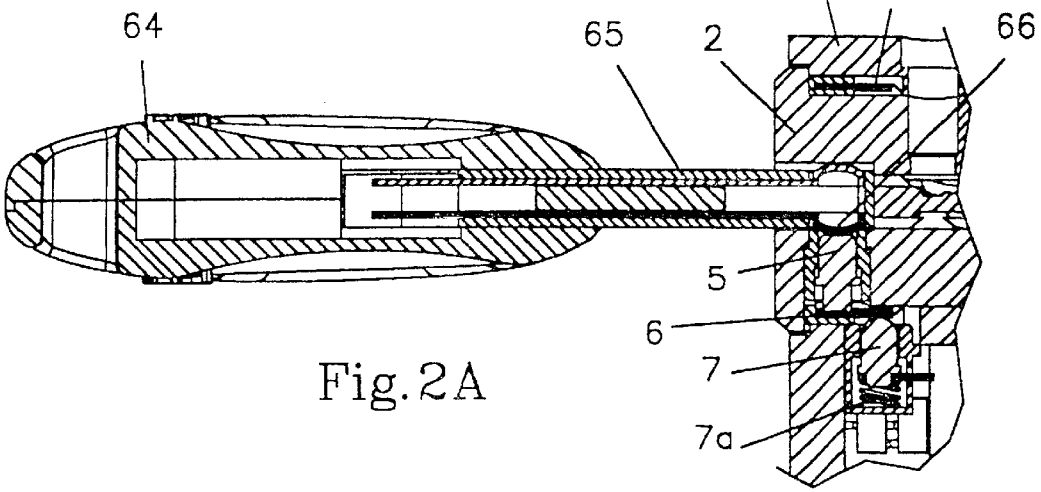

FIGS. 2 and 2A show two of the possible embodiments of the assembly formed by electrical contact (5), annular track (6) an electrical brush (7) in relation to terminals (66) of electronic key (64). In FIG. 2, said electrical contact (5) of said external (2) and internal (3) rotors is mounted against a first compression spring (5*a*); in this case, terminals (66) of key (64) have a rigid assembly. In FIG. 2A, this electrical contact (5) is actually immobile in said external (2) and internal (3) rotors; in this case, terminals (66) are mounted in blade (65) of electronic key (64) with the possibility of elastically bending in order to assure a permanent contact with the electrical contact (5), which in the previous case was produced by said first compression spring (5*a*). In both cases, electrical brush (7) is mounted against a second compression spring (7*a*).

Figures 11, 12, 13, 20, 21, 22:
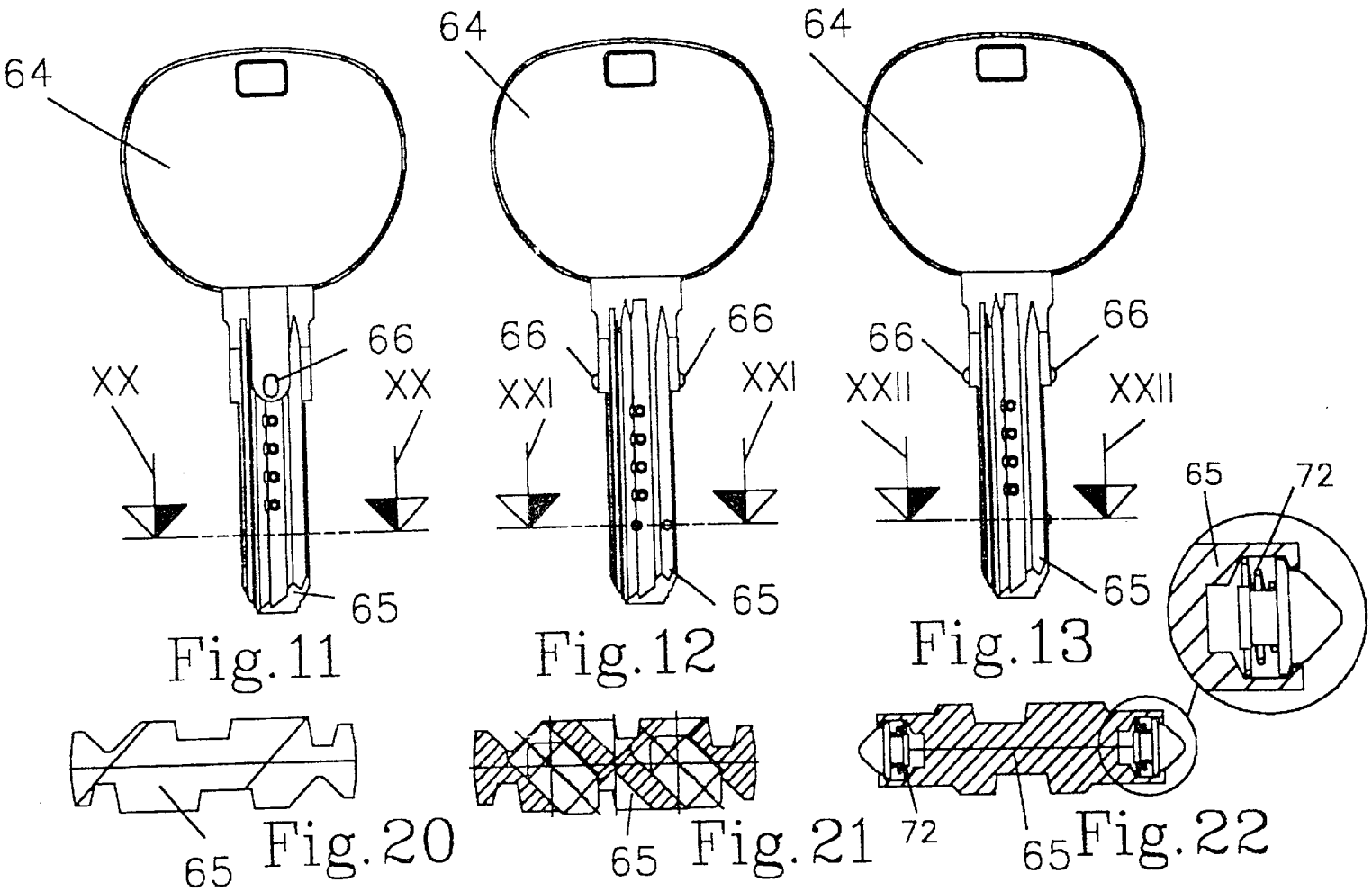
FIGS. 11 to 19 show different types of electronic keys (64) that can be used in the electronic cylinder of the invention.
FIGS. 20 to 27 are the respective cross sections of the blades (65) of the electronic keys of FIGS. 11 to 19.
Figures 14, 15, 16, 23, 24, 25:
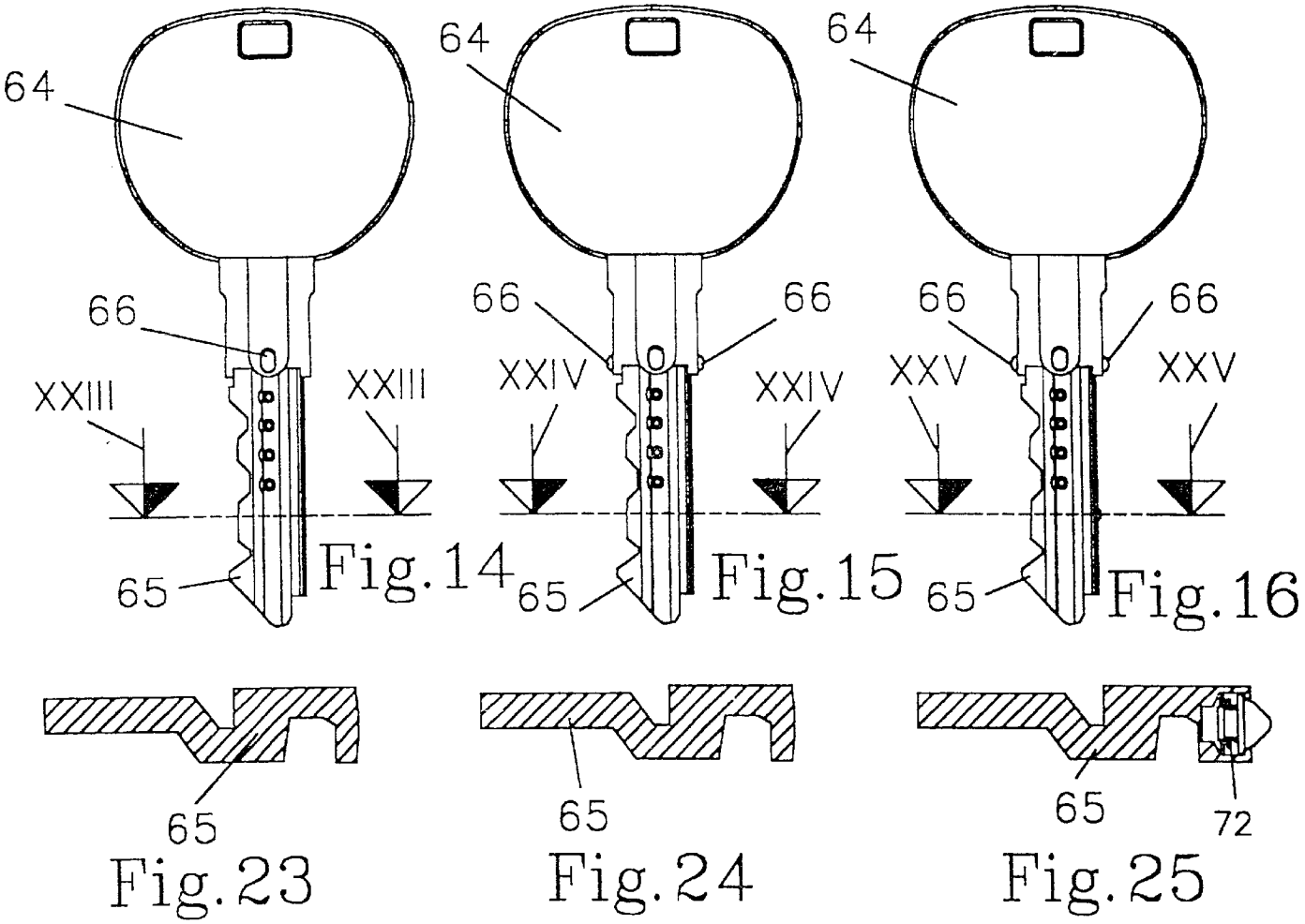
Figure 17:
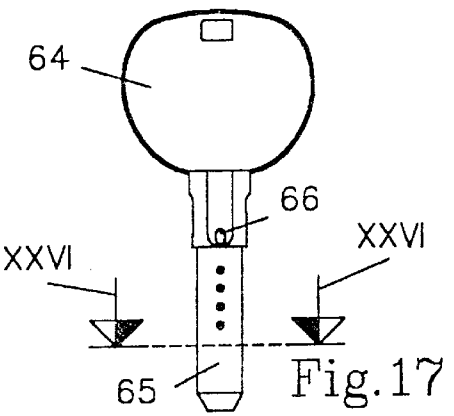
Figure 27:
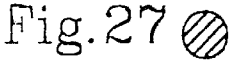
Figure 26:
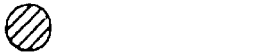
Figure 30:
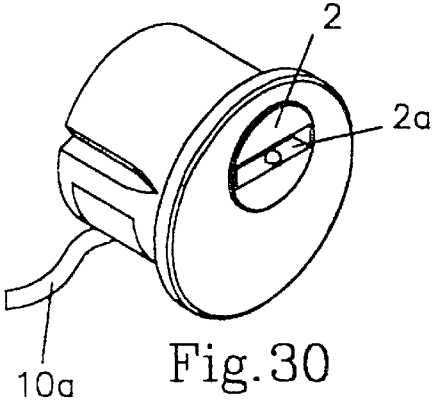
FIGS. 28 to 30 show in a perspective view each type of electronic cylinder according to the invention.
Figure 29:
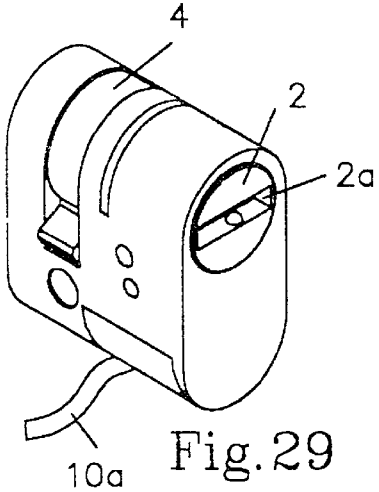
Figure 28:
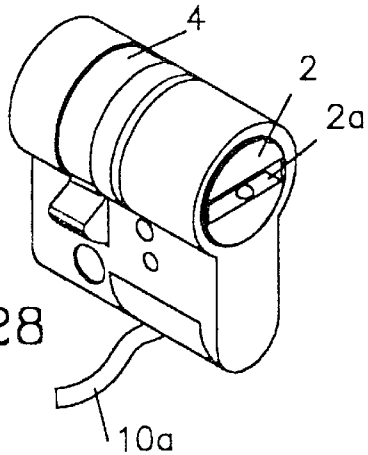

Annular track (6) makes possible two indistinguishable options with respect to the arrangement of electrical terminals (66) in blade (65) of electronic key (64). In one option, said electrical terminals (66) are in the major faces of a said blade (65) of electronic key (64), which is planar. In the other option, said electrical terminals (66) are in the minor faces of a said blade (65) of electronic key (64), which is planar. FIGS. 11, 14 and 17 show electronic keys (64) with blades (65) of various sections that have electrical terminals in the major faces of the same. FIGS. 12, 13, 15, 16 and 18 show electrical terminals (66) in the minor faces, or edges, of blade (65).

Figure 19:
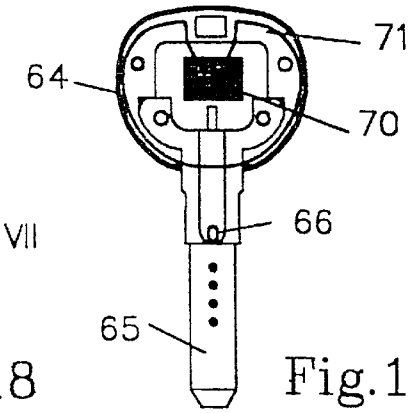
Figure 18:
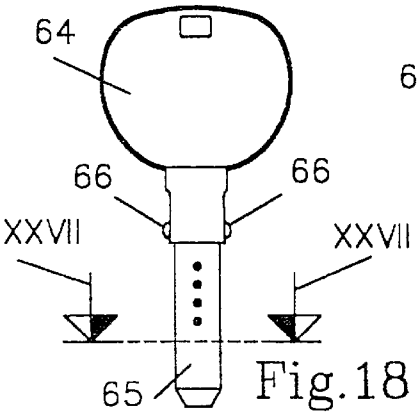

FIG. 19 shows an electronic key (64) of those that activate by proximity by means of an integrated electronic circuit (70) and an electrical conductor loop (71); in this electronic key (64), the electrical terminals (66) are on the major faces, but they can also be on the edges.

Said electromechanical device of rotational locking of said external rotor (2) comprises an armature (11), an autonomous electrical micromotor (12) which has a horizontal output rotational axis (13) and is located in a housing (14) of said armature (11), a vertical plate cam disk (15), a retractile vertical tumbler (16) located in said housing (14) of armature (11), and sticking out through the upper plane of this armature (11) a helical compression. spring (17) mounted vertically between first (27) and second (28) horizontal walls of said armature (11) and retractile tumbler (16), respectively, a base (18) anchored on the bottom to said armature (11) in vertical alignment with said retractile tumbler (16), and a ball (19) disposed freely in a variable space bounded between said plate cam disk (15), retractile tumbler (16) and base (18); said plate cam disk (15) has a vertical front of cam disk (20) horizontally facing said ball (19) and projecting in continuous form; said retractile tumbler (16) has an upper planar face (21) in permanent contact with the periphery of said external socket (32) with peripheral chamfer (33) and, opposite said upper planar face (21), said retractile tumbler (16) has on the bottom an inclined plane (22) of concave transverse profile circumscribed by an arc of greater radius than said ball (19) and facing this ball (19); said base (18) has on the top a horizontal plane (23) with concave transverse profile circumscribed by an arc of greater radius than said ball (19) and which is in permanent contact with this ball (19) and vertically facing said inclined plane (22) of retractile tumbler (16); said ball (19) has a diameter sufficient for simultaneous contact with said front of cam disk (20), concave inclined plane (22) of retractile tumbler (16) and concave horizontal plane (23) of base (18), and longitudinally to said concave horizontal plane (23), between said ball (19) and its point of contact with said concave inclined plane (22), there is a maximum distance that is equal to the horizontal variation in projection among the sections that protrude to varying degrees from said front of cam disk (20).

FIGS. 3 and 4 clearly illustrate the assembly and functioning of the device. FIG. 3 shows the device in the locked state, in which the plate cam disk (15) presents the most projecting section of the front of cam disk (20) to ball (19); then ball (19) is pushed onto the concave horizontal plane (23) of base (18) until it stops against concave inclined plane (22) of retractile tumbler (16); consequently, this tumbler (16) cannot descend and external socket (32) cannot be rotated because its peripheral chamfer (33) is coupled against the planar upper face (21) of said retractile tumbler (16). In this position of FIG. 3, the inclination of concave inclined plane (22) causes the fact that when rotation is forced in external circuit (32), the vertical force transmitted by retractile tumbler (16), is translated in good part to base (18), which provides the device with a great robustness and reliability of functioning. FIG. 4 shows the unlocked state of the device in which plate cam disk (15) presents the smallest projecting section of its front of cam disk (20) to ball (19); in this FIG. 4 is also shown an about-face rotated position of external socket (32), which has produced the descent of retractile tumbler (16) by means of the elastic compression of helical compression spring (17).

Only the reduced horizontal component of said force transmitted by tumbler (16) is transmitted orthogonally to the front of cam disk (20); the negative influence of this horizontal component on the output axis (13) of micromotor (12) is derived only from the very small nominal clearance (26) which is made by the back face (24) of plate cam disk (15) in order to assure rotation without abrasion of the same.

In order to minimize this effect without danger of producing abrasion in the rotation of plate cam disk (15), according to the invention, said plate cam disk (15) has a dorsal face (24) in which there is a projection (25) localized (FIG. 3A) at the most projecting zone of the front of cam disk (20) toward ball (19); said projection (25) projects to a smaller extent than a nominal clearance (26) of said dorsal face (24) with respect to said armature (11).

In this way, said nominal clearance (26) is appreciably decreased by coinciding with the end of the rotational operation of plate cam disk (15) in order to determine the state of blocking (FIG. 3); this detail of construction can be seen clearly in FIG. 3A.

Figures 5, 6:
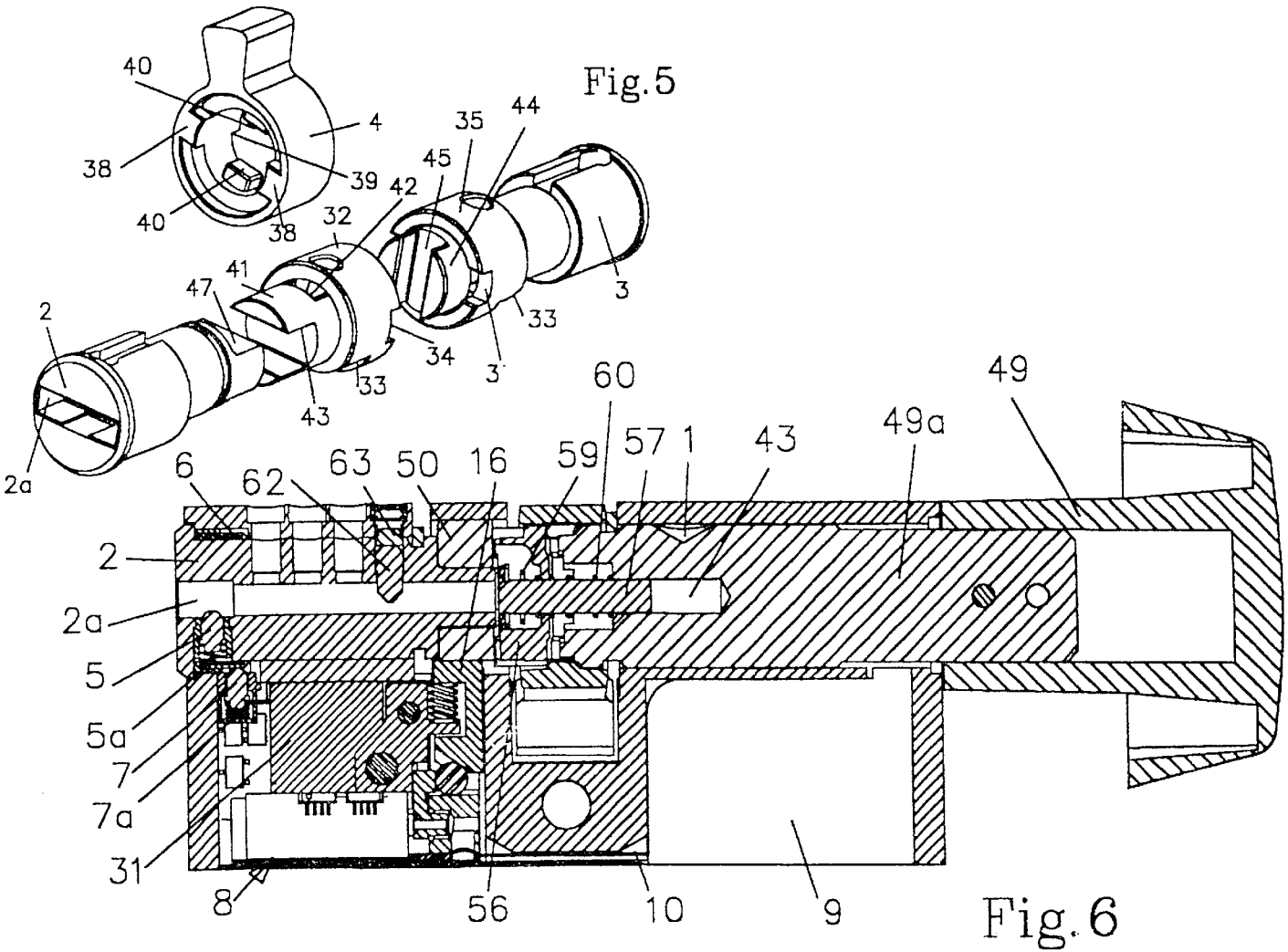
FIG. 5 is an exploded perspective view that shows the assembly between external (2) and internal (3) rotors according to the detail section of FIG. 1.
FIG. 6 is similar to FIG. 1, but refers to an electronic cylinder provided with external rotor (2) and with internal rotational button (49). In this FIG. 6, the electronic key (64) is not introduced into external rotor (2).
Figures 7, 8, 9, 10:
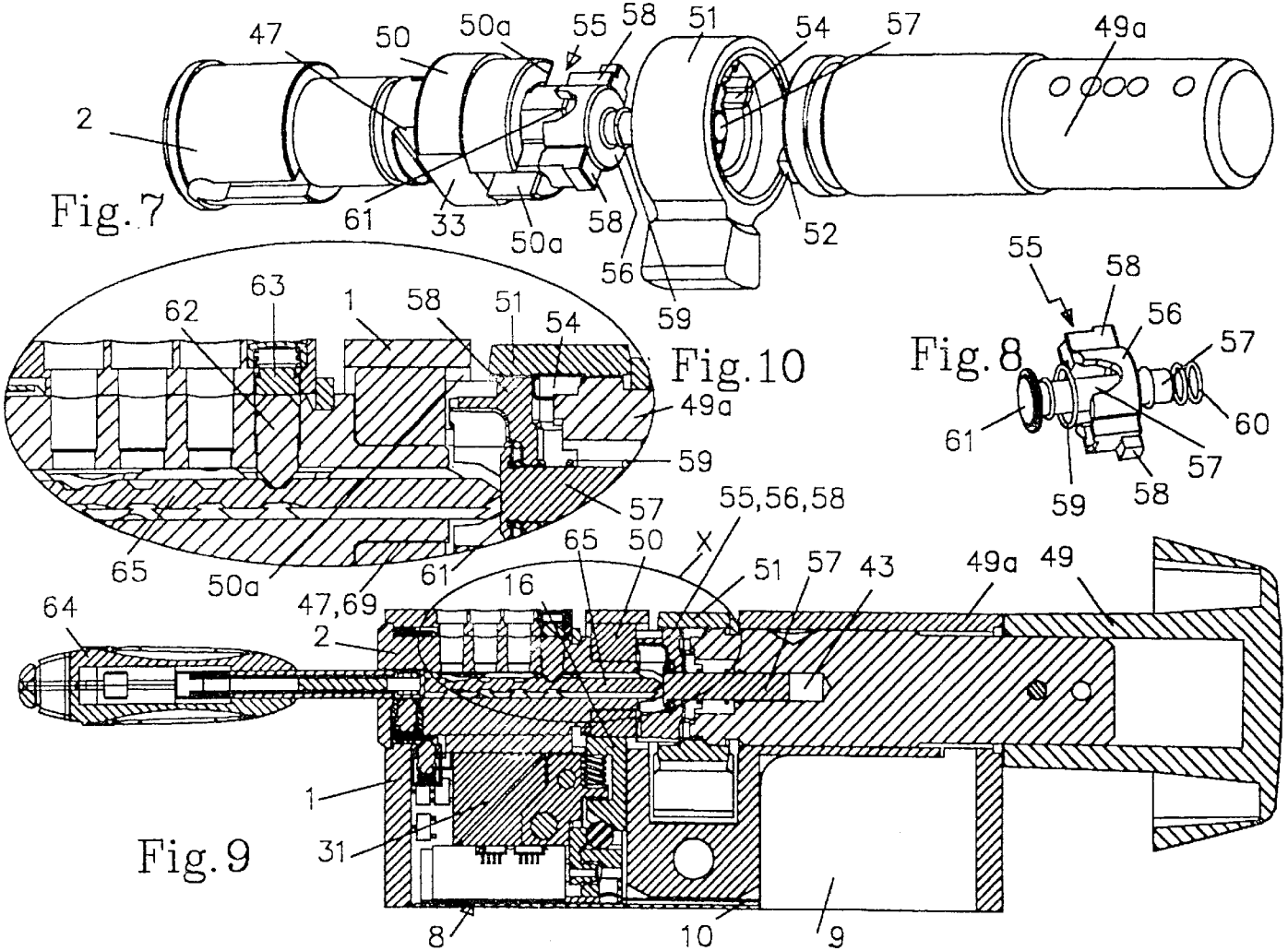
FIG. 7 is a similar perspective view to that of FIG. 5, but refers to the assembly between external rotor (2) and internal rotational button (49) according to FIG. 6.
FIG. 8 is a perspective view of coupling (55).
FIG. 9 is like FIG. 6, but showing the electronic key (64) introduced into the external rotor (2).
FIG. 10 is an enlargement of detail X that is circled in FIG. 9.

The assembly between external (2) and internal (3) rotors is illustrated by means of FIGS. 1 and 5. In this assembly, said first eccentric cam (4) has several first (38) and second (39) front teeth and several radial teeth (40); said first front teeth (38) are housed in several matching first front recesses (34) of said external socket (32) enclosed axially between the first eccentric cam itself (4) and external rotor (2); said second front teeth (39) are housed in several matching second front recesses (37) of said internal socket (35) axially enclosed between first eccentric cam (4) itself and internal rotor (3), and said radial teeth (40) are two that are diametrically opposed and that are aligned in the axial direction simultaneously with respective first front grooves (42) of said external shoe (41) and second front grooves (45) of said internal shoe (44). Said external (32) and internal (35) sockets each have peripheral chamfers (33) that are horizontal and oriented downward with respect to the initial position of the opening rotational operation on the part of this locking cylinder.

Said external (41) and internal (44) shoes each have first (43) and second (46) diametric recesses, in which are housed with sliding fit said first diametric planar lug (47) of external rotor (32) and said second diametric planar lug (48) of internal rotor (3), respectively. In this assembly, the following is fulfilled: the axial length comprised of said external (32) and internal (35) sockets enclosed between first eccentric cam (4) and external (2) and internal (3) rotors surpasses by an axial play (68) the axial length comprised of said external (41) and internal (44) shoes, which axial play (68) is equal to the axial length of said radial teeth (40) and their matching first (42) and second (45) front recesses of said external (41) and internal (44) shoes, respectively, which axial play (68) is equal to a measure in excess of that of inserted blade (65) of said electronic key (64) with respect to either of key channels (2*a*, 3*a*) of said external (2) and internal (3) rotors, and which axial play (68) is smaller than the same axial measurements between said first (43) and second (46) recesses of external (41) and internal (44) shoes, and of said first (47) and second (48) diametric planar lugs of external (2) and internal (3) rotors.

The functioning of this assembly consists of the following: external (32) and internal (35) sockets are always coupled by rotation with first eccentric cam (4), by means of enclosing the first (38) and the second (39) front teeth of this first eccentric cam (4) in the first front recesses (34) of external socket (32) and second front recesses (37) of internal socket (35), respectively; when electronic key (64) is introduced, for example, into external rotor (2) (FIG. 1), the point of blade (65) pushes away external shoe (41) which slides into its first diametric recess (43) with respect to the first diametric planar lug (47) of external rotor (2) while radial teeth (40) of first eccentric cam (4) are enclosed in its first front groove (42); this sliding of external shoe (41) pushes away internal shoe (44) until its second front groove (45) is disengaged from said radial teeth (40) of first eccentric cam (4), and the second diametric recess (46) receives totally the second diametric planar lug (48) of internal rotor (3); when key (64) is removed from external rotor (2) and introduced into internal rotor (3), the reverse operation to the one just explained is produced.

FIG. 1 shows the state in which key (64) is introduced, but still without being validated electronically, for which reason, retractile tumbler (16) cannot descend and external socket (32) (and therefore, external rotor (2)) cannot be rotated; when key (64) is validated, plate cam disk (15) passes to the position of FIG. 4 and it is possible to turn key (64).

When internal rotor (3) is substituted by a rotational button (49), the cylinder according to the invention comprises (FIGS. 6 to 10): a static double-body frame (1), of European profile in the form of a pear, for activation of the cylinder from the external and internal sides of the lock; an external rotational core or rotor (2), which possesses a channel (2*a*) for introduction of blade (65) of a corresponding electronic key (64) provided with an interactive electronic circuit that can be coded electronically, whose external rotor (2) rotates in the recess of the external body of said static double-body frame (1); an internal rotational button (49) provided with an axis (49*a*) that rotates in the recess of the inner body of said static double-body frame (1); an electrical contact (5) located in a radial housing of said external rotor (2) which communicates with its said key channel (2*a*) coinciding with the place where either one of the electrical terminals (66) that are disposed opposite each other on blade (65) of said electronic key (64) end up, when the key is inserted operatively into said key channel (2*a*); an electrically conducting annular track (6) that encircles said external rotor (2) and has its internal face in electrical communication with said electrical contact (5) of this external rotor (2); an electrical brush (7) that is in electrical communication with the external face of said annular track (6) and elastically loaded against a spring (7*a*); an electronic processing unit (31) which is in electrical communication with said electrical brush (7) of external rotor (2); a retractile vertical tumbler (16) which is mounted against a helical compression spring (17) radial to said external rotor (2) and which belongs to an electromechanical device of rotational blocking of said external rotor (2), which is electrically connected to said electronic processing unit (31); a second eccentric cam (51) installed between said external rotor (2) and axis (49*a*) of said rotational button (49); a radial vessel (50) axially enclosed between said second eccentric cam (51) and external rotor (2); a coupling device or coupling (55) located in the recess of said external socket (32) and between said external rotor (2) and said second eccentric cam (51); a first modular box (8) that has dimensions adapted to the inside of a first cast hollow part (1*a*) attached to external rotor (2) and that is made in said static double-body frame (1), and whose first modular box (8) contains said electrical brush (7) of external rotor (2), said electronic processing unit (31) and said electromechanical device of rotational locking of external rotor (2); a second modular box (9) that has dimensions adapted to the inside of a second cast hollow part (1*b*) attached to axis (49*a*) of rotational button (49) and which is made in said static double-body frame (1), and which second modular box (9) contains an autonomous electrical supply source; an electrical conductor (10) is connected between said first (8) and second (9) modular boxes.

In this case, said second eccentric cam (51) has a rounded hollow core of an annular body in which, in the axial direction, there are formed several slots (54) that are in communication with said hollow core, said slots (54) each enclosing front pieces (52) belonging to said axis (49*a*) of rotational button (49), whose front pieces (52) have an axial length that is half that of said axial slots (54) of eccentric cam (51).

For its part, said external socket (32) has a peripheral chamfer (33), several front gaps (50*a*) and a polygonal axial opening (69); said peripheral chamfer (33) is horizontal and oriented downward with respect to the initial position of rotational operation for opening this locking cylinder; said front gaps (50*a*) are in communication with the cast hollow core of said axial vessel (50) and in the axial direction have a notably greater length than that of said axial slots (54) of eccentric cam (51), which is not occupied by said front pieces (52) of axis (49*a*) of rotational button (49); and said polygonal axial opening (69) encloses reciprocally said first diametric planar lug (47) of external rotor (2).

The selective coupling between external rotor (2) and axis (49*a*) of rotational button (49) is made by said coupling (55), which is comprised of a body (56), an axial rod (57), a relatively strong helical spring (59) and a relatively weak helical spring (60); said body (56) takes the form of a cup with its inside oriented toward said external rotor (2) and is provided on the outside with several teeth (58) that extend in the axial direction and that, joined with the body itself (56), comprise an outline that with sliding fit matches the space formed jointly by the cast hollow core of said axial vessel (50) and its front gaps (50*a*), the axial length of said teeth (58) of body (56) being equal to that of these front gaps (50*a*) of axial vessel (50), and whose inside of said body (56) in the form of a cup has an axial length that is suitably greater than the excess extent of inserted blade (65) of said electronic key (64) with respect to said key channel (2*a*) of external rotor (2); said axial rod (57) has an enlarged front (61) supported at the final opening of said key channel (2*a*) of external rotor (2), and this axial rod (57) is mounted with sliding fit through said body (56) and has its inserted point with sliding fit end in a blind axial borehole (53) of said axis (50) of rotational button (49), whose blind axial borehole (53) has its bottom at a distance from the inside floor of said body (56) in the form of a cup that is greater than the length of said axial rod (57); said relatively strong helical spring (59) is a compression spring that is installed around said axial rod (57) between Its said enlarged front (61) and the inside floor of said body (56) in the form of a cup; said relatively weak helical spring is a compression spring that is installed around said axial rod (57) between the outside of said body (56) and the opening of said blind axial borehole (53) of axis (50) of rotational button (49).

This described assembly functions in the following manner: axis (49*a*) and second eccentric cam (51) are always coupled by means of the fit between their respective front pieces (52) and axial slots (54), with the particular feature that these axial slots (54) have approximately half of their length free; axial vessel (50) is permanently coupled with its polygonal axial opening (69), which encloses first diametric planar lug (47) of external rotor (2); this axial vessel (50) is permanently decoupled from said second eccentric cam (51) except when activated by coupling (55); when key (64) is not introduced into external rotor (2) (FIG. 6), relatively strong helical spring (59) is distended and the relatively weak helical spring (60) is loaded so that body (56) is permanently housed in the recess of axial vessel (50) and therefore, decoupled from second eccentric cam (51); with key (64) introduced (FIG. 9), if paraxial teeth (58) of body (56) of coupling (55) are aligned with said axial slots (54) of second eccentric cam (51), then pushing the point of blade (65) on front (61) of rod (57) compresses relatively weak helical spring (60) and one-half of said paraxial teeth (58) are lodged in the free half of said axial slots (54), while the other half of these paraxial teeth (58) are permanently coupled in said front gaps (50*a*) of axial vessel (50); with key (64) introduced and said paraxial teeth (58) not aligned (the situation in FIGS. 9 and 10) with axial slots (54), the point of blade (65) compresses the relatively strong helical spring (59), introducing rod (57) into blind axial borehole (53) of axis (49*a*); then by rotating key (64), axial vessel (50) entrains coupling (55) until said alignment occurs and the drive of relatively strong helical spring (59) produces the coupling as has been explained for the previous case.

In this version of the cylinder of the invention, all of what has been stated previously with regard to the electrical part and the electromechanical device for rotational locking remains valid.

Another particular feature of the invention is that there are at least said internal (3) and external (2) rotors, at least one cog (62) that has a point matching with a concavity (67) shaped in a central longitudinal border of blade (65) of said electronic key (64), which cog (62) has a corresponding counter-cog (63) mounted as a counter-spring in said static frame (1). This constitutes a safety means against attempts at front violation by introduction of objects into key channel (2*a*); four of these lug-counter lug (62–63) sets are provided in the cylinder of the invention.

On the other hand, the centered arrangement of these cogs (62) does not invade the zones of blade (65) of key (64) that are designed to bear the tracks or imprints corresponding to conventional combination shaped parts. In such a way, owing to these shaped parts, the electronic key (64) can be used to actuate electronically only with an electronic cylinder (as in the case of the subject of this invention), and at the same time can open other locks of the same user that have conventional mechanical combinations; this permits supplying electronic keys (64) to users that still do not have electronic cylinders, but may acquire them in the future, or who have electronic cylinders that still do not enjoy all the services that a modern electronic key can provide, but can aspire in future to cylinders providing these new services.

Having sufficiently described the nature of the present invention, as well as its industrial embodiment, it only remains to add that in its assembly and constituent parts, it is possible to introduce changes of shape, material and arrangement within the scope of the invention, as long as such alterations do not take away its basic principle.

What is claimed is:

1. A locking cylinder, particularly an electronic locking cylinder and with electromechanical rotational blocking, said locking cylinder comprising: a static double-body frame (1), of European profile in the form of a pear, for activation of said cylinder from the external and internal sides of the lock; each body having external (2) and internal (3) rotational cores or rotors each having a radial housing, which rotate in a recess of said two bodies of the static frame (1) and each of which has a key channel (2*a*, 3*a*) for introduction of the blade (65) of a corresponding electronic key (64) provided with an interactive electronic circuit that can be coded electronically; an electrical contact (5) positioned in said radial housing of each one of said external (2) and internal (3) rotors, which is in communication with its respective said key channel (2*a*, 3*a*) so as to contact either one of two electrical terminals (66) found opposite one another on said blade (65) of said electronic key (64) when said key is inserted operatively in said key channel (2*a*, 3*a*); an electrically conducting annular track (6) having an internal face and an external face, said track encircling each one of said external (2) and internal (3) rotors and having said internal face electrically communicating with each said electrical contact (5) of said rotors (2, 3); an electrical brush (7) which, in each one of said rotors (2, 3), communicates electrically with said external face of said annular track (6) and is loaded elastically against a second compression spring (7*a*); an electronic processing unit (31) which is in electrical communication with said electrical brushes (7) of said external (2) and internal (3) rotors; a retractile vertical tumbler (16) which is mounted against a helical compression spring (17) radial to said external rotor (2) and which belongs to an electromechanical device for rotational blocking of said external rotor (7) which is connected electrically to said electronic processing unit (31); a first eccentric cam (4) installed between said external (2) and internal (3) rotors; an external socket (32) enclosed axially between said first eccentric cam (4) and said external rotor (2); an internal socket (35) enclosed axially between said first eccentric cam (4) and said internal rotor (3); an external shoe (41) which is installed with axial clearance between said first eccentric cam (4) and said external rotor (2), which external shoe (41) has a sliding fit with respect to the inside of said external socket (32) and with respect to a first diametric planar lug (47) of said external rotor (2), which is located in the recess of said external shoe (41); an internal shoe (44) which is installed with axial clearance between said first eccentric cam (4) and said internal rotor (3), which internal shoe (44) has a sliding fit with respect to the inside of said internal socket (35) and with respect to a second diametric planar lug (48) which is located in the recess of said internal shoe (44); a first modular box (8) which has dimensions adapted to the inside of a first cast hollow part (1*a*) attached to said external rotor (2) which is made in said static double-body frame (1), said first modular box containing said electrical brush (7) of said external rotor (2), said electronic processing unit (31) and said electromechanical device for rotational locking of said external rotor (2); a second modular box (9) which has dimensions adapted to the inside of a second cast hollow part (1*b*) attached to said internal rotor (3), which is made in said static double-body frame (1), said second modular box (9)

containing an autonomous electrical supply source and said electrical brush (7) corresponding to said internal rotor (3); and an electrical conductor (10) connected between said first (8) and second (9) modular boxes.

2. A locking cylinder according to claim 1, wherein said first eccentric cam (4) has several first (38) and second (39) front teeth and several radial teeth (40); said first front teeth (38) are housed in several matching first front recesses (34) of said external socket (32) located axially between said first eccentric cam (4) itself and said external rotor (2); said second front teeth (39) are housed in several matching second front recesses (37) of said internal socket (35) enclosed axially between said first eccentric cam (4) itself and said internal rotor (3), and said radial teeth (40) are two that are diametrically opposed and that are aligned in the axial direction simultaneously with first front grooves (42) of said external shoe (41) and second front grooves (45) of said internal shoe (44), respectively.

3. A locking cylinder according to claim 1, wherein said external (41) and internal (44) shoes each have first (43) and second (46) diametric recesses, in which are respectively housed by way of a sliding fit said first diametric planar lug (47) of said external rotor (2) and said second diametric planar lug (48) of said internal rotor (3).

4. A locking cylinder according to claim 2, wherein the axial length included by said external (32) and internal (35) sockets fitted between said first eccentric cam (4) and said external (2) and internal (3) rotors, is greater by an axial clearance (68) than the axial length included by said external (41) and internal (44) shoes, which axial clearance (68) is equal to the axial length of said radial teeth (40) and their matching first (42) and second (45) front grooves of said external (41) and internal (44) shoes, respectively, which axial play (68) is equal to a measurement in excess of that of inserted blade (65) of said electronic key (64) with respect to either of key channels (2*a*, 3*a*) of said external (2) and internal (3) rotors, and which axial play (68) is smaller than the equal axial measurements between said first (43) and second (46) diametric recesses of said external (41) and internal (44) shoes, and of said first (47) and second (48) diametric planar lugs of said external (2) and internal (3) rotors.

5. A locking cylinder according to one of the following claims 1–4, wherein said external (32) and internal (35) sockets each have peripheral chamfers (33) that are horizontal and oriented downward with respect to the initial position of the rotational operation for opening said locking cylinder.

6. A locking cylinder, particularly an electronic locking cylinder and with electromechanical rotational blocking, said locking cylinder comprising: a static double-body frame (1), of European profile in the form of a pear, having external and internal casings each having a recess, said static double-body frame (1) for activating said cylinder from the external and internal sides of the lock; an external rotational core or rotor (2) which has a channel (2*a*) for introducing a blade (65) of a corresponding electronic key (64) provided with an interactive electronic circuit that can be coded electronically, said external rotor (2) having a radial housing and rotating in said recess of said external casing of said static double-body frame (1); an internal rotational button (49) provided with an axis (49*a*) which rotates in the recess of said internal casing of said static double-body frame (1); an electrical contact (5) located in said radial housing of said external rotor (2), which communicates with its said key channel (2*a*) so as to contact either of the electrical terminals (66) disposed opposite each other on blade (65) of said electronic key (64) when said key is inserted operatively into said key channel (2*a*); an electrically conducting annular track (6) having an internal face and an external face, said track encircling said external rotor (2) and having said internal face in electrical communication with said electrical contact (5) of said external rotor (2); an electrical brush (7) which is in electrical communication with said external face of said annular track (6) and is loaded elastically against a spring (7*a*); an electronic processing unit (31) which is in electrical communication with said electrical brush (7) of said external rotor (2); a retractile vertical tumbler (16) which is mounted against a helical compression spring (17) radial to said external rotor (2) and which belongs to an electromechanical device for rotational blocking of said external rotor (2) which is electrically connected to said electronic processing unit (31); a second eccentric cam (51) installed between said external rotor (2) and an axis (49*a*) of said rotational button (49); a radial vessel (50) inserted axially between said second eccentric cam (51) and said external rotor (2); a coupling device or coupling (55) located in the recess of said external socket (32) and between said external rotor (2) and said second eccentric cam (51); a first modular box (8) that has dimensions adapted to the inside of a first cast hollow part (1*a*) attached to external rotor (2) and that is made in said static double-body frame (1), said first modular box (8) containing said electrical brush (7) of said external rotor (2), said electronic processing unit (31) and said electromechanical device for rotational locking of said external rotor (2); a second modular box (9) that has dimensions adapted to the inside of a second cast hollow part (1*b*) attached to said axis (49*a*) of said rotational button (49) and which is made in said static double-body frame (1), said second modular box (9) containing an autonomous source of electrical supply; and an electrical conductor (10) connected between said first (8) and second (9) modular boxes.

7. A locking cylinder according to claim 6, wherein said second eccentric cam (51) has a rounded hollow core of an annular body in which is formed in the axial direction several slots (54) that are in communication with said hollow core, said axial slots (54) each having closed front pieces (52) belonging to said axis (49*a*) of said rotational button (49), whose front pieces (52) have an axial length that is half that of said axial slots (54) of eccentric cam (51).

8. A locking cylinder according to claim 6, wherein said axial vessel (50) has a peripheral chamfer (33), several front gaps (50*a*) and a polygonal axial opening (69); said peripheral chamfer (33) is horizontal and oriented downward with respect to the initial position of the rotational operation for opening said locking cylinder; wherein said front gaps (50*a*) communicate with the cast hollow core of said axial vessel (50) and, in the axial direction, have a length greater than that of said axial slots (54) of eccentric cam (51) that is not occupied by said front pieces (52) of said axis (49*a*) of said rotational button (49); and said polygonal axial opening (69) encloses reciprocally said first diametric planar lug (47) of said external rotor (2).

9. A locking cylinder according to claim 6, wherein said coupling (55) comprises a body (56), an axial rod (57) having a sliding fit end, a first helical spring (59) and a second helical spring (60) weaker than said first helical spring (59); said body (56) having the form of a cup with its inside oriented toward said external rotor (2) and being provided externally with several teeth (58) which extend in the axial direction and that, together with said body (56), comprise an outline that matches with sliding fit the space formed jointly by said cast hollow core of said axial vessel (50) and its front gaps (50*a*), the axial length of said teeth (58) of said body (56) being equal to that of said front gaps (50*a*) of said axial vessel (50), and wherein the inside of said body (56) in the form of a cup has an axial length that is greater than the excess measurement of said inserted blade (65) of said electronic key (64) with respect to said key channel (2*a*) of said external rotor (2); said axial rod (57) having an enlarged front (61) supported at the final opening of said key channel (2*a*) of said external rotor (2), and said axial rod (57) being mounted with said sliding fit end through said body (56) and having its inserted point with said sliding fit end in a blind axial borehole (53) of said axis (50) of said rotational button (49), said blind axial borehole (53) having its bottom at a distance from the inside floor of said body (55) in the form of a cup that is greater than the length of said axial rod (57); said first helical spring (59) comprising a compression spring that is installed around said axial rod (57) between its said enlarged front (61) and the inside floor of said body (56) in the shape of a cup; said second helical spring comprising a compression spring that is installed around said axial rod (57) between the outside of said body (56) and the opening of said blind axial borehole (53) of said axis (50) of said rotational button (49).

10. A locking cylinder according to claims 1 or 6, further characterized in that said electromechanical device for rotational locking of said external rotor (2) comprises an armature (11), an autonomous electrical micromotor (12) that has a horizontal rotational output axis (13) and is located in a housing (14) of said armature (11), a vertical plate cam disk (15), a retractile vertical tumbler (16) located in said housing (14) of said armature (11) and protruding through the upper plane of said armature (11), a helical compression spring (17) mounted vertically between first (27) and second (28) horizontal walls of said armature (11) and retractile tumbler (16), respectively, a base (18) anchored on the bottom to said armature (11) in vertical alignment with said retractile tumbler (16) and a ball (19) arranged freely in a variable space bounded between said plate cam disk (15), retractile tumbler (16) and base (18); said plate cam disk (15) having a vertical front of cam disk (20) horizontally facing said ball (19) and projecting in continuous form; said retractile tumbler (16) having an upper planar face (21) in permanent contact with the periphery of said external socket (32) with peripheral chamfer (33), and opposite said upper planar face (21); said retractile tumbler (16) having on the bottom an inclined plane (22) of concave transverse profile circumscribed by an arc of greater radius than said ball (19) and facing said ball (19); said base (18) having on top a horizontal plane (23) with concave transverse profile circumscribed by an arc of greater radius than said ball (19) and that is in permanent contact with said ball (19) and vertically faces said inclined plane (22) of said retractile tumbler (16); said ball (19) having a diameter that is sufficient for simultaneous contact with said front of said cam disk (20), said concave inclined plane (22) of said retractile tumbler (16) and said concave horizontal plane (23) of base (18), and wherein longitudinally to said concave horizontal plane (23), between said ball (19) and its contact point with said concave inclined plane (22), there is a maximum distance that is equal to the horizontal variation of projection of the sections that project to varying degrees of said front of said cam disk (20).

11. A locking cylinder according to claim 10, wherein said plate cam disk (15) has a dorsal face (24) in which there is a projection (25) localized at the most projecting zone of the front of cam disk (20) toward ball (19); wherein said projection (25) projects by a measurement less than a nominal clearance (26) of said dorsal face (24) with respect to said armature (11).

12. A locking cylinder according to claim 1 or 6, wherein in said internal (3) and external (2) rotors there is at least one cog (62) that has a point that matches with a concavity (67) shaped in a central longitudinal border of blade (65) of said electronic key (64), which cog (62) has a corresponding counter-cog (63) mounted as a counter-spring in said static frame (1).

13. A locking cylinder according to claim 1 or 6, wherein said electrically conducting annular track (6) is a ring opened by one of its generatrices.

14. A locking cylinder according to claim 1 or 6, wherein said electrical terminals (66) are in the major faces of a said blade (65) of electronic key (64) that is planar.

15. A locking cylinder according to claim 1 or 6, wherein said electrical terminals (66) are in the minor faces of a said blade (65) of electronic key (64) that is planar.

16. A locking cylinder according to claim 1 or 6, further comprising an external electrical conductor (10*a*) that is connected to said first modular box (8) and to a supply source external to said locking cylinder.

17. A locking cylinder according to claim 1 or 6, wherein said electrical contact (5) of said external (2) and internal (3) rotors is mounted against said first compression spring (5*a*).

18. A locking cylinder according to claim 1 or 6, wherein said electrical contact (5) is axially immobile in said external (2) and internal (3) rotors.

* * * * *